United States Patent [19]

Vassilatos

[11] Patent Number: 4,687,610

[45] Date of Patent: Aug. 18, 1987

[54] LOW CRYSTALLINITY POLYESTER YARN PRODUCED AT ULTRA HIGH SPINNING SPEEDS

[75] Inventor: George Vassilatos, Wilmington, Del.

[73] Assignee: E. I. Du Pont de Neumours and Company, Wilmington, Del.

[21] Appl. No.: 857,279

[22] Filed: Apr. 30, 1986

[51] Int. Cl.[4] ..... B28B 3/20

[52] U.S. Cl. ..... 264/211.14; 264/211.15; 264/211.17; 264/211.22

[58] Field of Search ..... 264/211.15, 211.17, 264/211.22, 211.14

[56] References Cited

U.S. PATENT DOCUMENTS

| | | | |
|---|---|---|---|
| 2,604,667 | 7/1952 | Hebeler | 264/210.8 |
| 2,957,747 | 10/1960 | Bowling | 264/168 |
| 4,134,882 | 1/1979 | Frankfort et al. | 528/309 |
| 4,195,051 | 3/1980 | Frankfort et al. | 264/176 |
| 4,338,275 | 7/1982 | Carr | 264/211.15 |
| 4,425,293 | 1/1984 | Vassilatos | 264/176 |
| 4,491,657 | 1/1985 | Saito et al. | 528/308.1 |

*Primary Examiner*—Lucille M. Phynes

[57] ABSTRACT

Spinning of polyethylene terephthalate yarn at speeds in excess of 5000 meters per minute using a gas management technique of the gas surrounding the threadline to control the temperature and attenuation profiles of a spinning threadline provides a means to produce a low crystallinity polyester yarn with a relatively high elongation to break.

2 Claims, 2 Drawing Figures

LOW CRYSTALLINITY POLYESTER YARN PRODUCED AT ULTRA HIGH SPINNING SPEEDS

BACKGROUND OF THE INVENTION

This invention relates to continuous filament polyester yarns having a low degree of crystallinity made by a high speed melt spinning process at controlled withdrawal speeds.

It has long been known that polymeric filaments, such as polyesters and polyamides, can be prepared directly, i.e., in the as-spun condition, without any need for drawing, by spinning at high speeds of the order of 5 km/min or more. This was first disclosed by Hebeler in U.S. Pat. No. 2,604,667 for polyesters, and by Bowling in U.S. Pat. No. 2,957,747 for polyamides. There has been increased interest in the last 10 years, as shown by the number of patent specifications disclosing methods of melt-spinning at these high spinning speeds.

Frankfort et al. in U.S. Pat. Nos. 4,134,882 and 4,195,051 disclose new uniform polyester filaments and continuous filament yarns of enhanced dyeability, low boil-off shrinkage and good thermal stability, prepared by spinning and winding directly at withdrawal speeds of 5 km/min or more. The highest speed exemplified is 8000 ypm. The withdrawal speed is the speed of the first driven roll wrapped (at least partially) by the filaments, i.e., the feed roll. When uniform polymeric filaments are desired, such as are suitable for continuous filament yarns, for example, it is essential to use a roll or equivalent positive means, driven at a constant controlled speed to withdraw the filaments, as opposed to an air jet ejector. The latter is satisfactory for some uses, such as non-woven products, but does not produce filaments that are sufficiently uniform for use as continuous filament yarns for most purposes.

Vassilatos in U.S. Pat. No. 4,425,293 discloses an oriented amorphous polyethylene terephthalate feed yarn for false-twist texturing prepared by spinning polyethylene terephthalate at a speed of at least 5000 m/min and quenching in a liquid bath to provide filaments having a boil off shrinkage (BOS) of at least 45% and no detectable crystallinity as measured by customary X-ray diffraction procedures. The liquid quenched yarn produced in U.S. Pat. No. 4,425,493 exhibits a rather low elongation to break, possibly attributable to the rapid quenching which introduces a large skin/core effect. By skin/core effect we refer to greater molecular orientation at the exterior or skin of the fiber than that orientation of the inner core. Such an effect is more pronounced when an effective quenching medium such as water is used rather than air. Upon loading, fibers with pronounced skin/core experience significant radial stress differences which lead to premature breaking. The production at ultra high speed, above 5000 m/min of a low crystallinity yarn with a higher elongation to break would be highly desirable.

SUMMARY OF THE INVENTION

The present invention provides a continuous filament polyester yarn melt spun at a spinning speed of at least 5 km/min. The filaments have a boil-off-shrinkage greater than 10%, an elongation to break in the range of from 30 to about 120% and a density in the range of 1.348 to 1.370 grams per ml. This is accomplished by spinning into a path from a spinning pack at a speed controlled by a withdrawal means and directing a gas into a zone enclosing said path, said zone extending from said spinning pack to a location between the spinning pack and the withdrawal means and maintaining said zone under superatmospheric pressure of less than 1 kg/cm$^2$. The velocity of the gas is increased as it leaves the zone to a level greater than the velocity of the filaments.

DETAILED DESCRIPTION OF THE ILLUSTRATED EMBODIMENT

Figure 1:
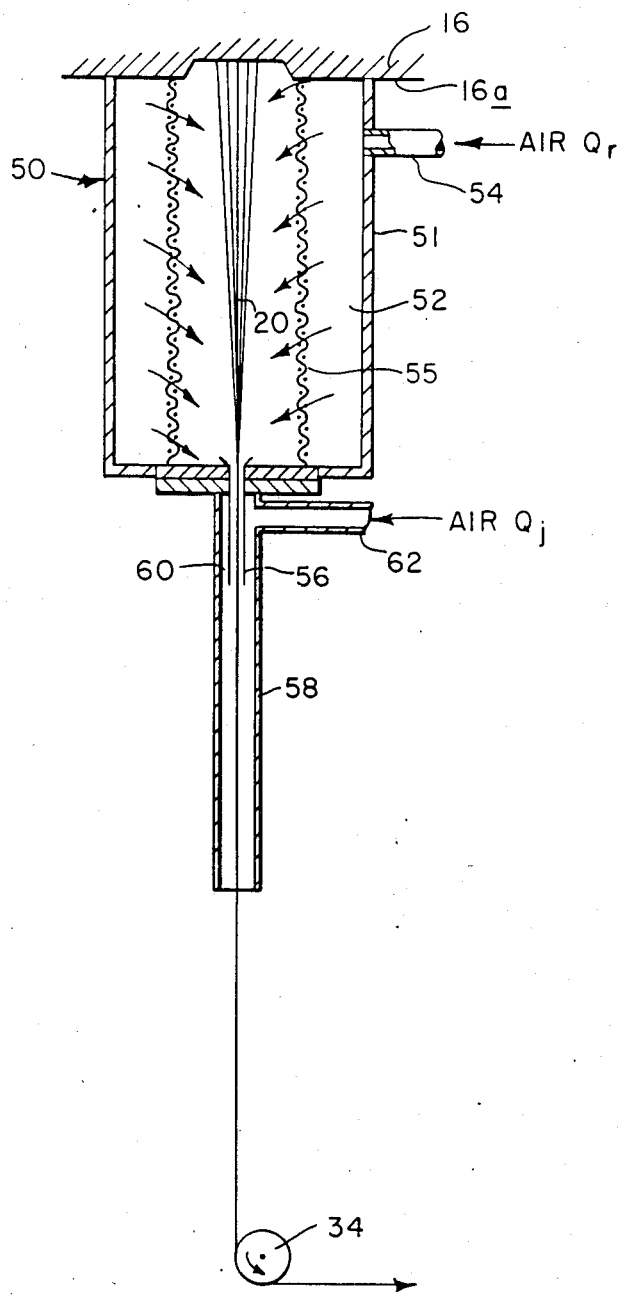
FIG. 1. is a schematic elevation view partially in section of one embodiment of the apparatus for practicing the invention.

Referring to FIG. 1, this embodiment includes a housing 50 which forms a chamber 52, i.e., an enclosed zone supplied with pressurized gas $Q_R$ through inlet conduit 54 which is formed in the side wall 51 of the housing. A cylindrical screen 55 is positioned in chamber 52 to uniformly distribute gas flowing into the chamber. A spinning pack 16 is positioned centrally with and directly above the housing which abuts the surface 16*a* of the pack. A spinneret (not shown) is attached to the bottom surface of the spinning pack for extruding filaments 20 into a path from molten polymer supplied to the pack. A tube 56 is joined to the housing 50 at the outlet end of the housing in line with the path of the filaments. The top of the tube is A continuous wall or second tube 58 slightly flared. A continuous wall or second tube 58 surrounds tube 56 and is spaced therefrom to form an annular space 60 surrounding the tube 56. The wall is joined to the housing 50 at the outlet of the housing. An inlet pipe 62 through the wall 58 provides a means to supply pressurized gas $Q_J$ to space 60. In operation a molten polymer is metered into a spinning pack 16 and extruded as filaments 20. The filaments are pulled from the spinneret into a path by withdrawal roll 34. The withdrawal of the filaments is assisted by the gas flow through straight tube 56. The diameters of tubes 56, 58 and the flow rates $Q_R$ and $Q_J$ are chosen in such a way as to have equal average gas velocity in both tubes. In this manner disturbance of the filaments at the exit of tube 56 into the tube 58 is minimized. Furthermore, the tube 56 should be well centered and the flow $Q_J$ uniformly distributed so that the gas velocity in the annulus 60 between the two tubes is the same at any circumferential position. Also, the velocity of the gas in the annulus should be about two (2) times greater than the common velocity in the two tubes, but not significantly greater than that.

The location of the beginning of tube 56 should be above the location along the spinline at which crystallization would occur without the presence of the tube. It has been reported in *High-Speed Fiber Spinning,* Edited by A. Ziabicki and H. Kawai, John Wiley and Sons, New York (1985) that crystalline polymers, such as polyethylene terephthalate or nylon-66, which are spun to form fibers at high rates of withdrawal, e.g., over 4,500 m/mm, crystallize along the spinline very suddenly. Indeed, the location of crystallization can be identified by the formation of a "neck" which is a very sudden reduction of the diameter of the moving spinline at the point of crystallization. Since upon reduction of its diameter the spinline has to accelerate to preserve the constant mass flow rate provided at the spinneret capillary, it is clear that the location of crystallization can be alternatively identified by finding the location along the spinline where the velocity suddenly increases almost as a step function. Measurement of the spinline velocity can be performed with a laser-doppler velocimeter.

The velocity of the gas (preferably room temperature air) in the tubes 56 and 58 may be at least one and one half (1.5) to about one hundred (100) times the velocity of the filaments so that the air exerts a pulling effect on the filaments which increases as the length of these tubes increases. Also, the pulling effect increases as the gas velocity increases which happens when $Q_R$ and $Q_J$ increase or when the tube diameter decreases at constant $Q_R$ and $Q_J$. Besides pulling the filaments, the higher gas velocity in the tubes brings about more rapid cooling of the filaments inside the tubes and even more so after the tube exit because of the mild turbulence created at the breakup point of the exiting gas stream which intensifies cooling. A desirable location of the beginning of tube 56 is between five (5) and two hundred and fifty (250) centimeters above the "neck" location when the tubes are not present, preferably between ten (10) and ninety (90) centimeters. By doing so, crystallization is suppressed, high speed of withdrawal is maintained, and the low crystallinity yarn of this invention is produced.

Figure 2:
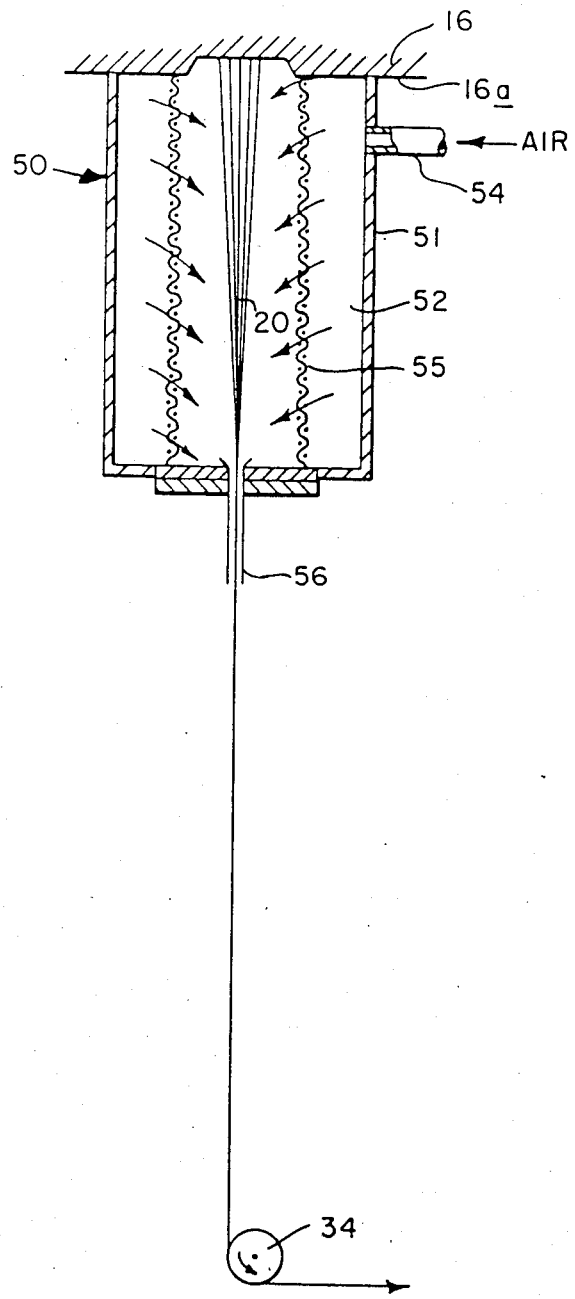
FIG. 2. is a schematic elevation view partially in section of another embodiment of an apparatus for practicing the invention.

FIG. 2 illustrates an embodiment similar to FIG. 1 except the tube 58 is removed. Operation is in the manner described in Example I.

TESTS

T/E/Mi—tenacity and initial modulus are in grams per denier and elongation is in %, measured according to ASTM D2256 using a 10 in (25.4 cm) gauge length sample, at 65% RH and 70 degrees F., at an elongation rate of 60% per min.

Density—determined from density gradient tube experiments by the method of ASTM D15056-68.

Boil-Off-Shrinkage—measured as described in U.S. Pat. No. 4,156,071 at column 6, line 51.

EXAMPLE I

Polyethylene terephthalate, having an intrinsic viscosity of 0.63 which is measured in a mixed solution of 1:2 volume ratio of phenol and tetrachloroethane, was extruded from a spinneret having 4 fine holes of 0.25 mm diameter equally spaced 0.25 cm apart on a straight line at a spinning temperature of 90° C., and at a rate of 3.1 gms per minute per hole. The extruded filaments were passed through an air supplying chamber with an inside diameter of 7.6 cm and a length of 43 cm provided immediately below the surface of the spinneret. Air of about 20° C. was supplied through the wire mesh cylinder at the rate of 30 scfm. The bottom of the housing was covered by a plate with an opening at its center which allowed a tube with an inside diameter of 1.25 cm and a length of 5.0 cm to be attached to it. The top of the tube was slightly flared as shown in FIG. 2.

The air supplying chamber is sealed against the bottom of the spinning block so that air supplied through the chamber can only escape through the tube at its bottom. The air flow rate was measured and the pressure maintained in the chamber below the spinneret was calculated to be about 0.01 kg/cm$^2$ above the atmospheric pressure. Upon leaving the tube, the filaments travel in air for about 280 cm before taken up by rotating rolls. When the takeup speed of the rolls was 5,948 m/min, the velocity of the spinning filaments at the exit of the tube was 1,280 m/min or about 19% of the velocity of the air in the tube. Furthermore, the velocity profile of the spinning filaments increased smoothly to the final takeup velocity without sign of any sudden velocity change or "neck" formation. This is an indication that no significant crystallization took place along the spinning filament. This contrasts the velocity profile of the spinning filaments without the tube at the bottom of the air supplying chamber. In the latter case, the velocity profile showed a sudden and sharp increase ("neck" formation) from about 1,647 m/min to the final velocity of 5,948 m/min at a distance of about 118 cm from spinneret exit. At the location corresponding to the exit of the tube, the velocity of the spinning threadline was about 229 m/min. The takeup speeds of the fibers and their properties are shown in Table I. Finish and mild interlacing were applied to the spinning filaments before they reached the takeup roll.

TABLE I

| Spinning or Takeup Speed m/min | % BOS | Density gms/ml | Tenacity g/d | % Elongation to Break | Modulus g/d |
|---|---|---|---|---|---|
| 6,405 | 45 | 1.3578 | 2.3 | 79 | 47 |
| 7,320 | 32 | 1.3563 | 2.5 | 38 | 70 |
| 8,235 | 15 | 1.3668 | 3.0 | 31 | 75 |

EXAMPLE II

Polyethylene terephthalate, having an intrinsic viscosity of 0.63 which is measured in a mixed solution of 1:2 volume ratio of phenol and tetrachloroethane, was extruded from a spinneret having 17 fine holes of 0.25 mm diameter of which seven and ten holes were equally spaced on the circumference of two circles of 3.8 cm and 5.4 cm in diameter respectively at a spinning temperature of 290° C. and at a rate of 2.5 gms per minute per hole.

The extruded filaments were passed through an air supplying chamber as described in Example I. The tube attached to the bottom of the chamber had an inside diameter equal to 1.27 cm and a length equal to 15.3 cm. This tube discharged the gas into a second tube of an inside diameter equal to 1.9 cm and length equal to 17.8 cm as shown in FIG. 1. Additional quench gas of a flow rate $Q_J$ equal to 25 scfm was metered into the tube. The flow $Q_R$ metered into the chamber was 20 scfm. Both streams were at about 20° C. The air flows were measured and the pressure maintained in the chamber below the spinneret was calculated to be about 0.02 kg/cm$^2$. The filaments exiting the small tube were straight, taut and separate from each other. They remained so even when traveling in the larger outside tube as could be observed through the transparent plastic walls of the tube. The improvement brought about by the outside tube consisted in keeping the filaments straight and separated until they had the time to cool more to minimize potential sticking between them upon exiting the large tube where the breakup of the exiting gas stream might create turbulence. Furthermore, the use of two controlled gas flows, $Q_R$ and $Q_J$, provides more process control. It allows control of the spinning filament velocity profile and of its temperature profile as well. For example, by adding the second stream $Q_J$, a larger heat sink becomes available for the filaments to cool because the gas mass is greater and its temperature does not rise significantly. The takeup speeds of the fiber and their properties are shown in Table II. Finish and mild interlacing were applied to the spinning filaments before they reached the takeup roll

TABLE II

| Spinning or Takeup Speed m/min | % BOS | Density gms/ml | Tenacity g/d | % Elongation to Break | Modulus g/d |
|---|---|---|---|---|---|
| 7,000 | 63 | 1.3570 | 2.4 | 65 | 41 |
| 8,000 | 50 | 1.3582 | 3.0 | 53 | 51 |
| 9,000 | 21 | 1.3688 | 3.4 | 37 | 55 |

EXAMPLE III

As described in Example II, polyethylene terephthalate was extruded from a spinneret with the following differences:

The spinneret had 5 holes. The throughput was 4.45 gms/min per hole. The tube attached to the bottom of the chamber had an inside diameter equal to 1.17 cm and a length equal to 15.3 cm. The outside tube had an inside diameter equal to 1.90 cm and a length equal to 49.8 cm. The gas flow rates $Q_R$ and $Q_J$ were 7.5 and 20 scfm respectively.

The collected samples had the properties shown in Table III.

TABLE III

| Spinning or Takeup Speed m/min | % BOS | Density gms/ml | Tenacity g/d | % Elongation to break | Modulus (i) g/d |
|---|---|---|---|---|---|
| 5,500 | 57.1 | 1.3554 | 1.6 | 117 | 26.9 |
| 7,000 | 55.5 | 1.3549 | 2.0 | 58 | 63.4 |
| 8,000 | 52.8 | 1.3563 | 3.2 | 48 | 76.5 |

EXAMPLE IV

As described in Example II, polyethylene terephthalate was extruded from a spinneret except that $Q_R$ and $Q_J$ were 25 scfm and 31.2 scfm respectively. The collected samples had the properties shown in Table IV.

TABLE IV

| Spinning or Takeup Speed m/min | % BOS | Density gms/ml | Tenacity g/d | % Elongation to break | Modulus (i) g/d |
|---|---|---|---|---|---|
| 6,000 | 62.8 | 1.3550 | 1.4 | 88.2 | 29.5 |
| 7,000 | 65.8 | 1.3540 | 1.7 | 68.5 | 34.5 |
| 8,000 | 66.6 | 1.3548 | 2.2 | 43.5 | 53.3 |
| 9,000 | 62.2 | 1.3550 | 2.4 | 31.2 | 67.7 |

EXAMPLE V

As described in Example II, polyethylene terephthalate was extruded from a spinneret except that the polymer throughput was 2.5 gms/min per hole and $Q_R$ and $Q_J$ were 40 scfm and 30 scfm respectively. The collected samples had the properties shown in Table V.

TABLE V

| Spinning or Takeup Speed m/min | % BOS | Density gms/ml | Tenacity g/d | % Elongation to break | Modulus (i) g/d |
|---|---|---|---|---|---|
| 6,000 | 62.3 | 1.3488 | 1.6 | 35.9 | 33.6 |
| 8,000 | 61.6 | 1.3516 | 2.2 | 40.8 | 40.9 |
| 10,000 | 57.7 | 1.3524 | 2.5 | 42.7 | 42.8 |
| 10,500 | 59.3 | 1.3530 | 2.8 | 48.7 | 33.9 |

What is claimed is:

1. A continuous filament polyester yarn melt spun in a path from a spinning pack at a spinning speed of at least 5 km/min controlled by a withdrawal means by directing a gas into a zone enclosing said path, said zone extending from said spinning pack to a location between the spinning pack and the withdrawal means maintaining said zone under superatmospheric pressure of less than 1 kg/cm$^2$ and increasing the velocity of the gas as it leaves the zone to a level greater than the velocity of the filaments, said yarn having a density in the range of from about 1.348 to about 1.370 grams per ml, having an elongation break in the range of from 30% to 120% and having a boil-off-shrinkage which is at least 10%.

2. The yarn of claim 1, said density being from 1.350 to 1.360 grams per ml.

* * * * *